United States Patent [19]

Gaté et al.

[11] Patent Number: 4,934,480

[45] Date of Patent: Jun. 19, 1990

[54] DEVICE FOR THE FASTENING OF COVERS OR PANELS FOR THE DECORATION AND SHIELDING OF INSTRUMENTS, ESPECIALLY ELECTRICAL AND ELECTRONIC INSTRUMENTS

[75] Inventors: Hubert Gaté, Tierce; Dominique Huerre, Angers, both of France

[73] Assignee: Societe Electronique de la Region Pays de Loire, Paris, France

[21] Appl. No.: 359,331

[22] Filed: May 31, 1989

[30] Foreign Application Priority Data

Jun. 3, 1988 [FR] France ..... 88 07405

[51] Int. Cl.[5] ..... G10K 11/00

[52] U.S. Cl. ..... 181/150; 181/175; 381/189

[58] Field of Search ..... 181/150, 175; 381/189

[56] References Cited

U.S. PATENT DOCUMENTS 4,244,096 1/1981 Kashichi ..... 181/199 X
4,424,381 1/1984 Hattori ..... 181/155

FOREIGN PATENT DOCUMENTS 3311666 10/1984 Fed. Rep. of Germany .
660106 3/1987 Switzerland .
1390796 4/1975 United Kingdom .

*Primary Examiner*—Benjamin R. Fuller
*Attorney, Agent, or Firm*—Oblon, Spivak, McClelland, Maier & Neustadt

[57] ABSTRACT

To fasten metallic or plastic covers or panels to supporting surfaces, snapping-in lugs are formed on these covers. These lugs are inserted into the slots of the supporting surface.

5 Claims, 1 Drawing Sheet

DEVICE FOR THE FASTENING OF COVERS OR PANELS FOR THE DECORATION AND SHIELDING OF INSTRUMENTS, ESPECIALLY ELECTRICAL AND ELECTRONIC INSTRUMENTS

BACKGROUND OF THE INVENTION

1. Field of the Invention

An object of the present invention is a device to fasten or fix covers (which may or may not be perforated or partially perforated) or panels to decorate and protect or shield instruments, especially electrical and electronic instruments.

2. Description of the Prior Art

Decorative and shielding covers such as covers for the front faces of electronic instruments and loudspeaker boxes, whether metallic or made of plastic, must, in most cases, be solidly fixed to their supports in order to prevent them from vibrating. This may be a source of problems, and may cause them to be detached if they are not securely fixed. To ensure that their fastening is vibration resistant, these covers are generally provided with sufficiently long lugs, the ends of which are twisted. However, this kind of operation cannot be easily automated, and requires access through the rear of the box or casing. In another known device to fasten covers of this type, the covers are provided with lugs having a hole into which a pawl, forming one piece with the box, is fastened by being snapped in, but this kind of approach does not enable the fastening of the cover to withstand the vibrations for very long, because the usual tolerances for large scale batch production do not ensure that the slot is positioned with adequate precision.

SUMMARY OF THE INVENTION

An object of the present invention is a simple device for the fastening of covers or panels of the above-mentioned type, ensuring that they have very high resistance to vibrations and are capable of taking plastic as well as metallic covers, and enabling the positioning of these covers to be easily automated.

The above, and other objects are achieved according to the present invention by an assembly of a casing for a vibration generating device and at least two types of decorative covers fastenable to the casing, having an arrangement for fastening the covers to the casing, including at least two types of slots in the casing, each of the types of slots corresponding to one of the types of covers, a part of a wall of the casing at which the slots are formed being elastic. At least two types of fastening lugs are provided, each of the types of fastening lugs being mounted to one of the types of covers and being sized and positioned for fitting in a corresponding one of the types of slots when the one of the types of covers is to be mounted to the casing. Each of the fastening lugs has bosses that cooperate with the elastic part of the wall for retaining a respective cover on the casing.

According to a further feature of the invention, the elastic part of the wall is formed of the pair of the two types of slots positioned sufficiently close together that the wall of the casing between the slots is elastic.

According to a further feature of the invention, each of the bosses has an insertion face angled by an angle $\alpha_1$ with respect to the length of the lug upon which the boss is formed, and a rear face which cooperates with the elastic part of the wall and which is angled by an angle $\alpha_2$ with respect to the length of the lug. The angles $\alpha_1$ and $\alpha_2$ are related such that $\alpha_2$ is greater than $\alpha_1$.

According to another characteristic of the invention, when the covers to be fixed are metallic and have to be electrically connected to a reference potential, connection lugs are formed on these covers, one of the big sides of each of these lugs being substantially rectilinear.

BRIEF DESCRIPTION OF THE DRAWINGS

The present invention will be better understood from the following detailed description of two embodiments, taken as non-restrictive examples and illustrated by the appended drawing, wherein.

DESCRIPTION OF PREFERRED EMBODIMENTS

The invention is described below with reference to an decorative cover designed to be fixed to the molded plastic front of a casing such as a television receiver to which are fixed vibration generating devices, for example, loudspeakers, control buttons, etc. It is clearly understood that the invention can be implemented to fix a partially perforated or unperforated decorative and/or shielding cover or panel on to a supporting surface so that its assembly can be done by simple translation and can, therefore, be easily robotized.

Figure 1:
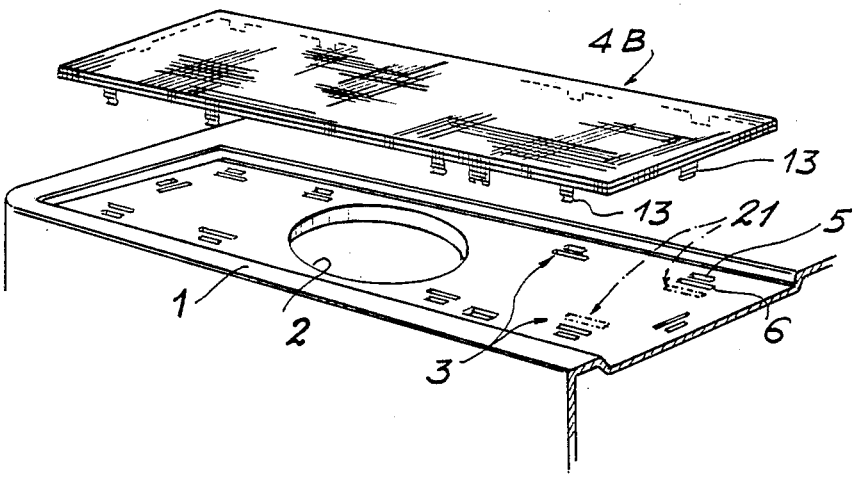
FIG. 1 shows an exploded view, in perspective, of a supporting part and a decorative cover which is made of plastic.

FIG. 1 shows a part of a front 1 of a television set, made by plastic molding. A circular hole 2, can be seen thereon. Behind this slot is fixed a loudspeaker (not shown).

Figure 2:
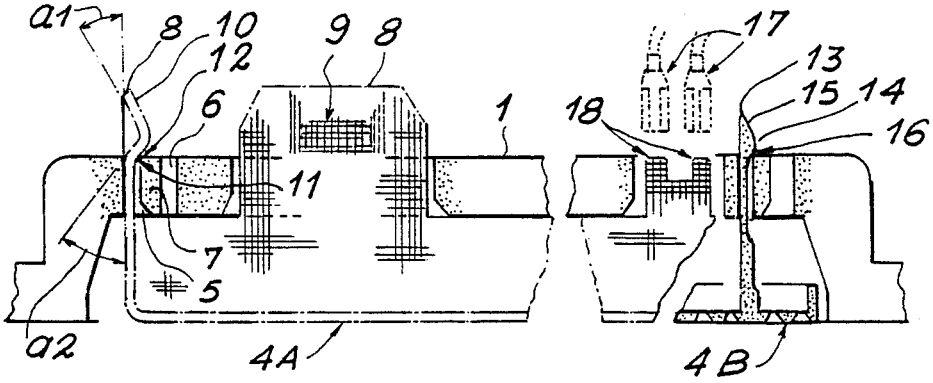
FIG. 2 shows a sectional view of two embodiments of the device of the invention for metallic and plastic covers.
Figure 3:
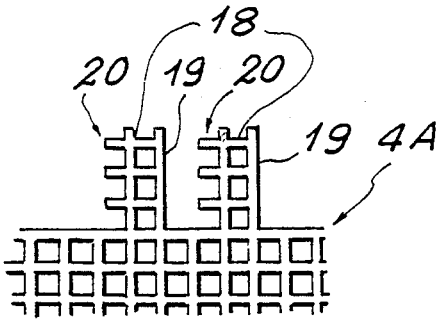
FIG. 3 is an enlarged detailed view of connection lugs of the metallic cover of FIG. 2.

The front 1 has several pairs 3 of two types of slots 5 and 6 distributed on its periphery for the fastening of an decorative cover 4A (made of metal) shown on the left-hand side of FIG. 2 or 4B (made of plastic) shown on the right-hand side of FIG. 2.

Each pair 3 has two rectangular slots 5, 6, that are parallel to each other. In the present example, these slots are parallel to the sides of the cover 4A (or 4B). The width of the partition wall 7 between the slots 5, 6, is such that, given the thickness of the front 1 around the slots 5, 6, this partition wall has sufficient elasticity and solidness to let bosses formed on fixing lugs of the cover pass through and to retain them, whether this cover is metallic or plastic. For, it is advantageous that a single model of a front should be capable of taking both metallic and plastic covers so as to customize different series of television sets while changing the minimum number possible of elements.

In the present example, for a thickness of about 3 mm. for the front 1 around slots 5, 6, the width of the partition 7 (namely the distance between the slots 5 and 6) is about 2 mm., the slots 5 and 6 having a length of about 15 to 25 mm.

Should the cover be metallic (cover 4A), it has lugs 8, about 20 mm. wide, designed to be inserted into the external slots 5. Each of these lugs 8 has, on its internal face, a boss 9 made by simple drawing. The boss 9, which is substantially pyramid shaped, has a substantially plane insertion face 10 that forms an angle a1 with the plane of the rest of the lug 8. The rear face 11 of the boss 9, which forms its active face (namely the face that retains the lug in the slot) forms an angle a2 with the plane of the rest of the lug 8. According to an advantageous feature of the invention, the angle a1 is smaller than the angle a2. In one embodiment, the angle a1 is about 30°, and the angle a2 is about 60°. Thus, the small angle a1 enables easy insertion of the lug in the corresponding slot while the angle a2, which is greater, enables the lug to be held properly in the slot by strongly resisting the removal of the lug. Of course, the face 11 is long enough to compensate for the tolerance values applied in the covers and the fronts, i.e. the shoulder 12 of the slot 5 should always bear on the face 11 when the cover is in position. Thus, the boss 9 enables an adjustment of clearance.

When the cover is made of plastic (4B), it is formed with lugs 13, the ends of which are formed with bosses 14 similar to the bosses 9 of the lugs 8. These bosses 14 are formed on the external faces of the lugs 13, since these lugs are designed to be inserted, according to the present example, in the internal slots 6. Just as for the bosses 9, the bosses 14 have an insertion face 15 having a smaller slope than that of the rear face 16.

When the cover is metallic, and when it is desired to connect it to the ground of the television set by means of connectors such as the sockets 17, shown in the drawing, at least one connection lug 18 is formed on this cover. To make it easier to insert these lugs in the connectors 17, they are cut in such a way that one of their big sides, for example the side 19, is rectilinear. Since the pitch of the cover may be highly variable, it is quite possible that, if these lugs are cut to the necessary width without accurately positioning the lines of the cut, the two sides of the lug will bristle like the sides 20 of the lugs 18, making it difficult to insert the lugs into the connectors 17.

To dismantle the cover (4A or 4B), it is possible to act directly on the lugs as well as to act on the front. For, in the latter case, it is possible to provide, for example in the vicinity of the slots 5, 6, for slots 21 into which a screwdriver is inserted and pushed towards the slots 5, 6, if the cover is made of plastic or moved away from these slots if the cover is metallic, in order to move the partition 7 away from the boss 14 or 9. The cover can thus be dismantled without damaging it and without necessarily having access to the fastening lugs.

Of course, the number of lugs depends on the dimensions of the cover, its shape and its rigidity.

What is claimed is:

1. In an assembly of a casing for a vibration generating device and at least two types of decorative covers fastenable to said casing, an arrangement for fastening a selected one of said covers to said casing comprising:

at least two types of slots in said casing, each of said types of slots corresponding to one of said types of covers, a part of a wall of said casing at which said slots are formed being elastic; and at least two types of fastening lugs, each of said types of fastening lugs being mounted to one of said types of covers and being sized and positioned for fitting in a corresponding one of said types of slots when said one of said types of covers is to be mounted to said casing, each of said fastening lugs having bosses that cooperate with said elastic part of said wall for retaining a respective cover on said casing.

2. The assembly of claim 1 wherein each said elastic part of said wall is formed of a pair of said two types of slots positioned sufficiently close together that the wall of the casing between the slots is elastic.

3. The assembly of claim 1 wherein each of said bosses has an insertion face angled by an angle $\alpha_1$ with respect to a length of the lug upon which the boss is formed, and a rear face which cooperates with said elastic part of said wall and which is angled by an angle $\alpha_2$ with respect to the length of said lug, wherein angle $\alpha_2 >$ angle $\alpha_1$.

4. The assembly according to claim 1 including additional slots in a vicinity of said two types of slots to enable the removal of the covers.

5. The assembly of claim 1 including electrical connection lugs in said covers, a longer side of said connection lugs being substantially rectilinear.

* * * * *